United States Patent [19]

Ichiyanagi et al.

[11] 4,130,676

[45] Dec. 19, 1978

[54] COATING APPARATUS AND METHOD

[75] Inventors: Takashi Ichiyanagi; Takashige Akiyama, both of Hirakata; Ichizo Otoda, Ikeda, all of Japan

[73] Assignee: Matsushita Electric Industrial Co., Ltd., Kadoma, Japan

[21] Appl. No.: 777,549

[22] Filed: Mar. 14, 1977

[51] Int. Cl.[2] ..... B05C 3/02; B44D 1/42

[52] U.S. Cl. ..... 427/358; 427/117; 427/118; 118/405; 118/DIG. 18

[58] Field of Search ..... 118/125, 404, 405, DIG. 18; 427/356, 357, 358

[56] References Cited

U.S. PATENT DOCUMENTS

| | | | |
|---|---|---|---|
| 2,131,598 | 9/1938 | Obermaier | 118/DIG. 18 |
| 2,194,565 | 3/1940 | Moss | 118/DIG. 18 |
| 2,787,980 | 4/1957 | McDermott | 118/405 |
| 2,974,056 | 3/1961 | Namenyi-Katz | 118/DIG. 18 |
| 3,060,889 | 10/1962 | Knapp | 118/125 X |
| 3,227,577 | 1/1966 | Baessler et al. | 427/357 X |

FOREIGN PATENT DOCUMENTS

| | | | |
|---|---|---|---|
| 26914 | 6/1956 | Fed. Rep. of Germany | 118/125 |
| 927701 | 6/1963 | United Kingdom | 118/125 |

*Primary Examiner*—Wm. Carter Reynolds

[57] ABSTRACT

A coating apparatus of die coating type for applying coating solution onto materials such as wires to be coated which includes a floating die having a hole therethrough gradually narrowing in the direction of advance of the material to be coated for allowing the material after having passed through the coating solution to pass through the die, and a thrust bearing provided with lubricating means for reducing the friction in the radial direction and disposed at the outlet side of the floating die in a direction normal to the path of advance of the material to be coated for improved follow-up performance of the floating die with respect to the lateral movements of the advancing material to obtain a uniform coating film on the material to be coated.

8 Claims, 11 Drawing Figures

FIG. 2 (b) Prior Art
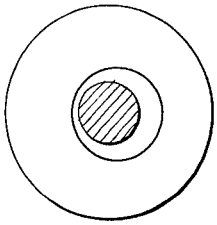
FIG. 2 (a) Prior Art
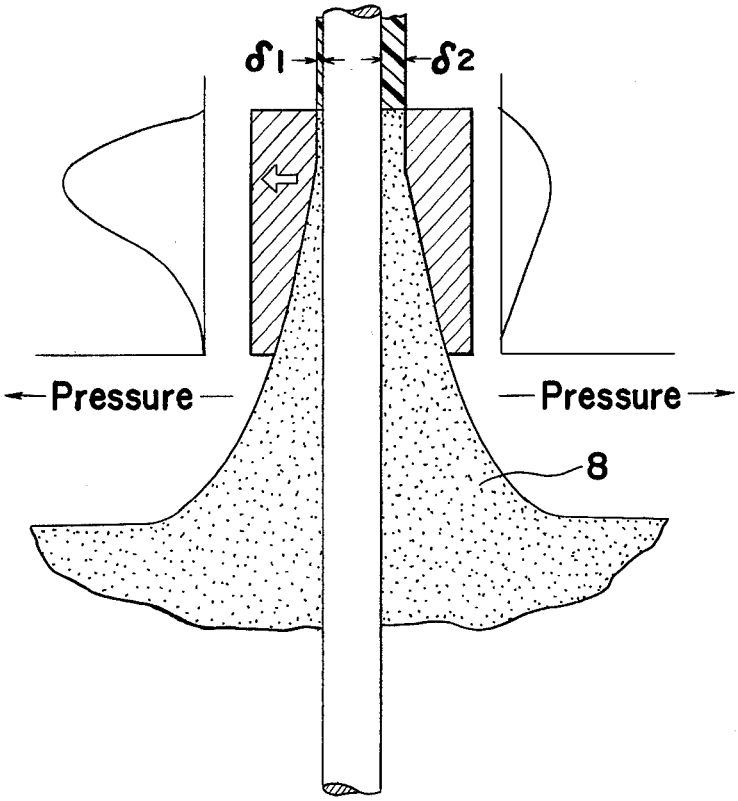

COATING APPARATUS AND METHOD

The present invention relates to a coating apparatus and more particularly, to a die coating apparatus for applying coating compounds or solution onto external surfaces of materials to be coated, for example, bare wires and the like so as to form coating films on such materials, which coating apparatus is useful for obtaining wires having various coatings such as electrically conductive wires having insulating coverings on the outer surfaces thereof as in conductive windings for motors, relays, transformers, etc., lead wires formed with electrically insulating coverings thereon, wires having zinc coatings on the outer surfaces, or the like.

Figure 1:
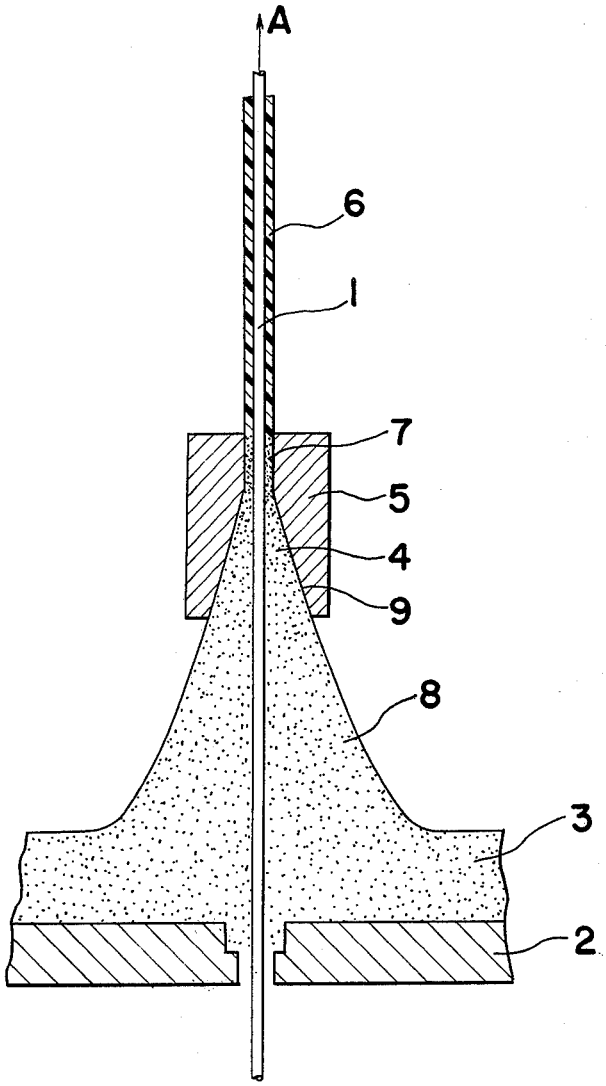
FIG. 1 Prior Art

In the conventional coating apparatus as shown in FIGS. 1, 2*a* and 2*b*, for uniformly applying a coating solution of resinous materials having an electrically insulating property and viscosity such as polyvinyl formal, polyester, varnish or the like onto external surfaces, for example, of bare wires, the bare wire 1 is moved vertically upward in the direction of the arrow A through the coating solution 3 accommodated in a pot or container 2, while the same wire 1 is passed through an opening 4 which is formed in a floating die 5 kept floating on the coating solution 3 and which gradually narrows in the direction of advance of the wire 1 for squeezing off extra coating solution 3 so as to form a coating film 6 of uniform thickness on the surface of the wire 1.

In the arrangement as described above, the floating die 5 must be kept floating on the coating solution 3, and in order to maintain the floating die 5 in the optimum floating state, it is necessary to have the buoyancy due to the hydrodynamic effect of the coating solution 3 and the gravitational force arising from the mass of the die well balanced, the former being related to the viscous shearing force produced by the coating solution 3 located at a narrowed portion 7 of the opening 4 due to the relative speed of the die 5 and the wire 1, and the upward component of the hydrodynamic positive pressure acting on the wall surface of the opening 4 due to a wedge action effect, while the latter is related to the gravitational force acting on the die 5 and a raised portion 8 of the coating solution 3. In other words, the floating condition of the die 5 is adjusted by reducing the mass of the die 5 when the floating die 5 does not float, and by increasing the mass of the same die 5 if the tendency of the die 5 to float is considered excessive.

The reason for employing the floating die 5 to form a coating film 6 of uniform thickness is that, if the axis of the narrowed portion 7 of the floating die opening 4 goes out of alignment with that of the wire 1, resulting in a difference between clearances $\delta_1$ and $\delta_2$ between the wire and the die opening 4, for example, with the clearance $\delta_1$ being small as compared with the clearance $\delta_2$ as shown in FIGS. 2*a* and 2*b*, the internal pressure in the coating solution in the vicinity of a tapered portion 9 of the opening 4 in the floating die 5 due to the wedge action effect becomes larger at the side of the clearance $\delta_1$ as compared with the side of the clearance $\delta_2$, the difference in pressure therebetween moving the die 5 in the direction of the arrow in FIG. 2*a* so as to automatically restore the coaxial relation of the wire 1 with respect to the floating die 5.

In the conventional arrangement as described above, however, even if a force for restoring the coaxial relation between the wire 1 and the die 5 is exerted upon the die 5, it has been impossible to make the coating 6 uniform at all times, since the floating die 5 has a poor follow-up performance with respect to a deviating movement or lateral deflection of the wire 1 due to time-lag arising from inertia because of the large mass of the die 5 and the coating solution 3. In other words, so far as the above described deficiency is concerned, improvements may be made by increasing the dynamic response of the die 5 through reduction of mass of the floating die 5 and that of the raised portion 8 of the coating solution 3, but due to the fact that the mass of the die 5 and the solution 3 can not be reduced sufficiently so as to maintain the floating die 5 in the optimum floating condition as earlier described, the problem of unevenness in the amount of coating solution applied onto the surface of the wire 1 due to the poor follow-up performance of the floating die 5 is left unsolved.

Accordingly, an essential object of the present invention is to provide a coating apparatus which is capable of evenly applying coating solution onto external surfaces of materials such as wires to be coated.

Another important object of the present invention is to provide a coating apparatus of the above described type in which a floating die has an improved moving response in the radial direction for forming a coating film of uniform thickness on the materials to be coated, with substantial elimination of the disadvantages inherent in the conventional coating apparatuses.

A further object of the present invention is to provide a coating apparatus of the above described type in which the coating film formed on the materials to be coated is free from any soiling.

A still further object of the present invention is to provide a coating apparatus of the above described type which has a simple construction and functions stably, and can be manufactured at low cost.

In accomplishing these and other objects, according to one preferred embodiment of the present invention, the coating apparatus includes a floating die which has an opening therethrough which gradually narrows in the direction of advance of the material to be coated for allowing the material after having passed through coating solution to pass therethrough, and a thrust bearing provided with lubricating means for reducing the friction in the radial direction and disposed at the outlet or discharge side of the floating die in a direction normal to the advancing path of the material to be coated, by which arrangement the follow-up performance of the floating die with respect to the lateral movement or deflection of the material to be coated is much improved, with consequent uniform thickness of the coating film formed on the material to be coated, while the necessity for adjusting the mass of the floating die to hold the die in the floating condition is advantageously eliminated.

Figure 3:
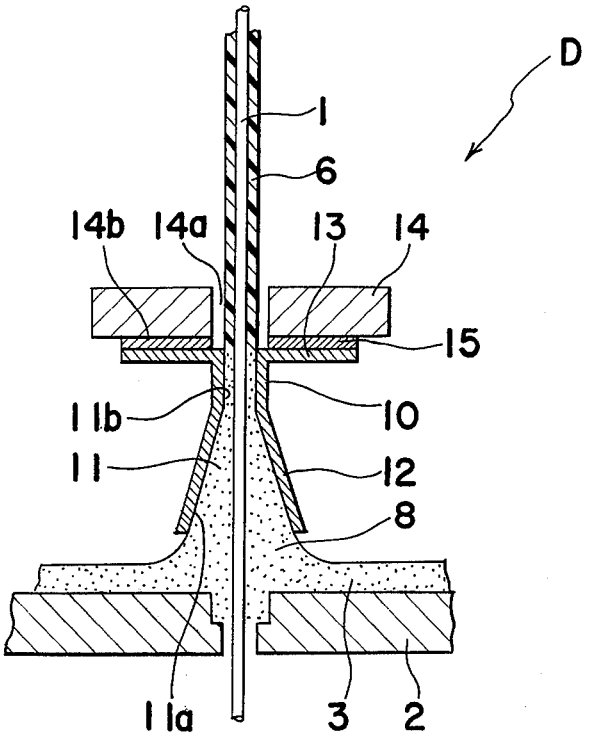
Figure 4:
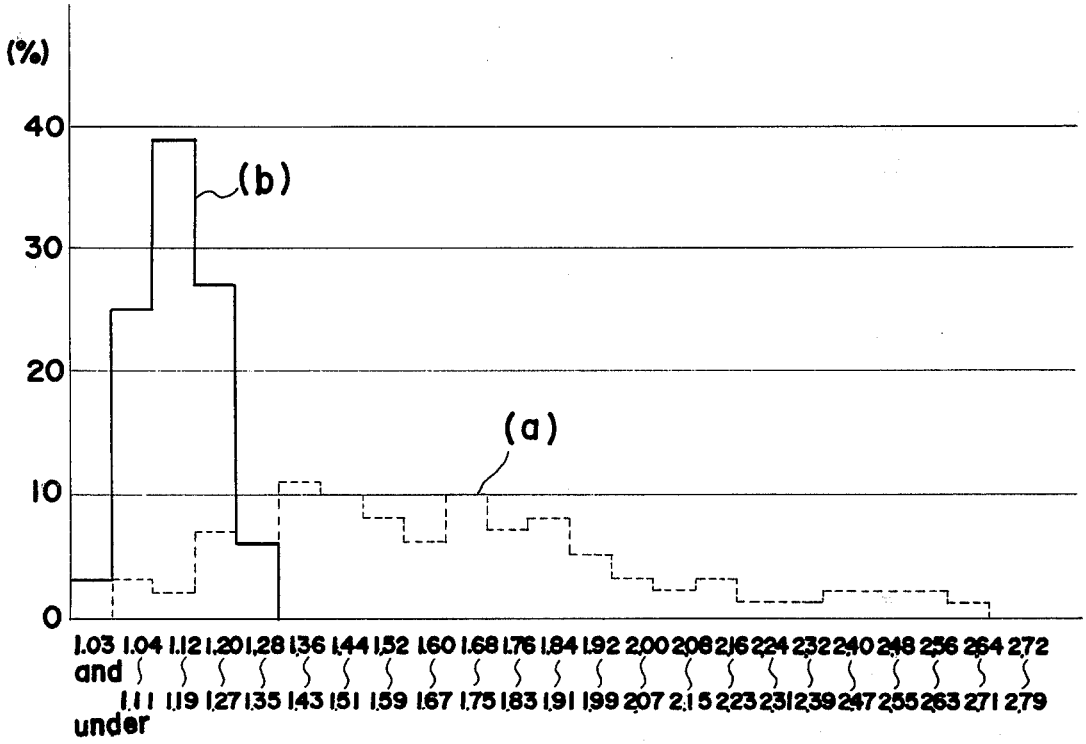
Figure 3A:
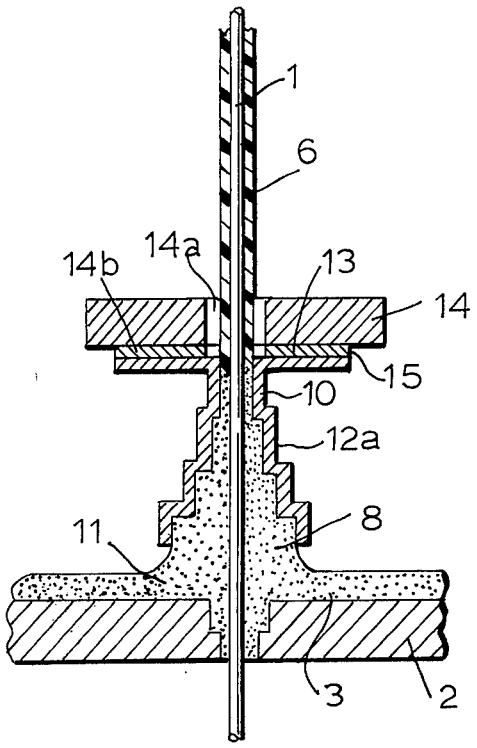
Figure 5:
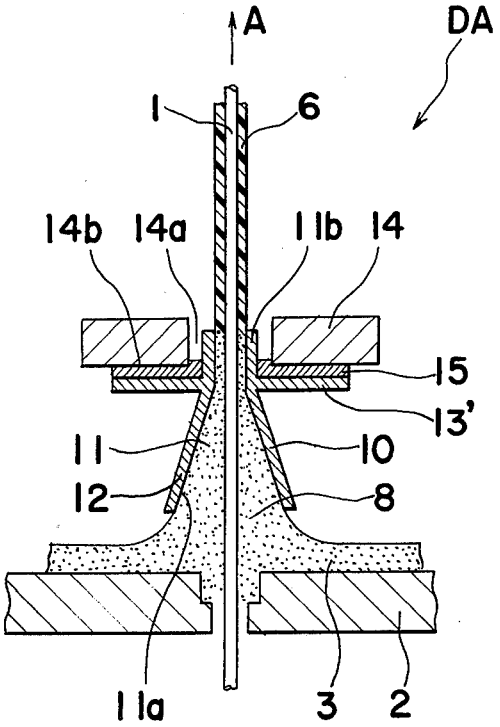
Figure 6:
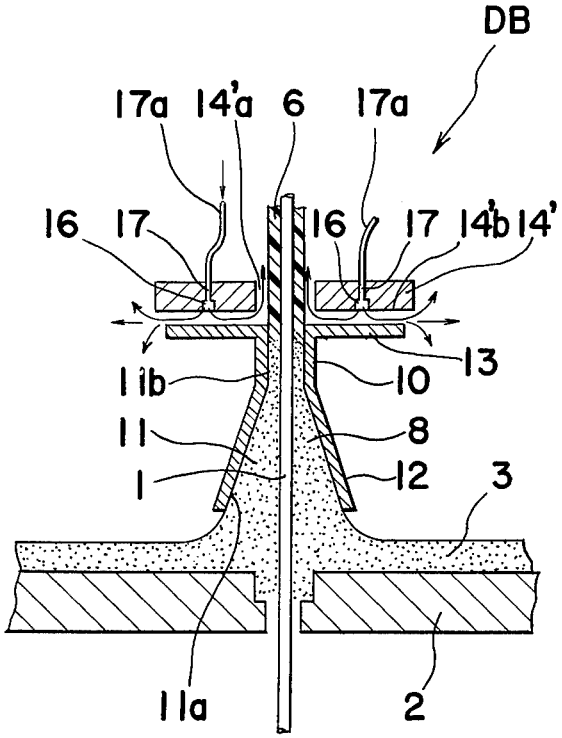
Figure 6:
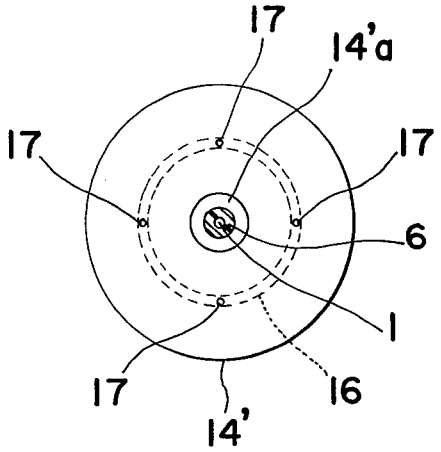
Figure 7:
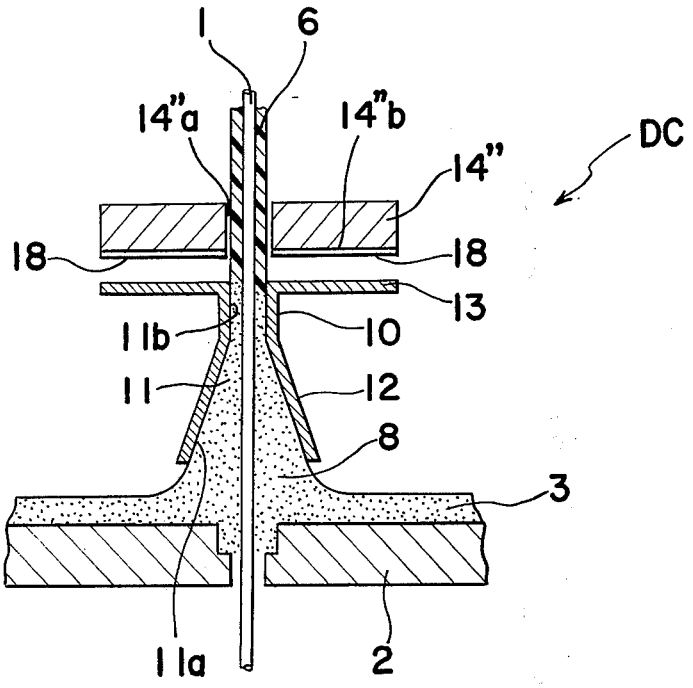
Figure 7:
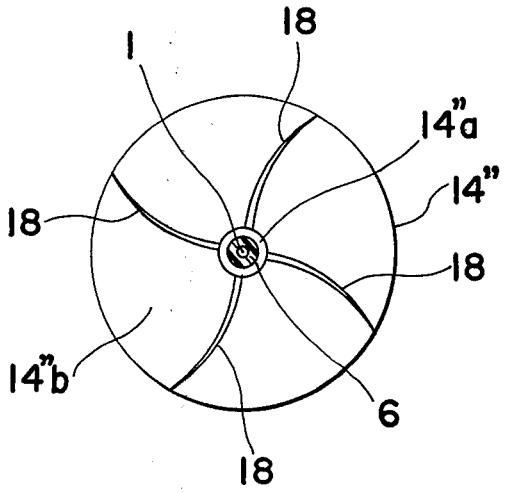

These and other objects and features of the present invention will become apparent from the following description taken in conjunction with the preferred embodiment thereof with reference to the attached drawings, in which;

FIG. 1 is a schematic sectional view showing an essential portion of a conventional coating apparatus which has already been referred to, FIG. 2(*a*) is a schematic sectional view showing, on an enlarged scale, the relation between the material to be coated and a floating die employed in the conventional coating apparatus of FIG. 1, FIG. 2(*b*) is a top plan view showing the relation between the material to be coated and the floating die employed in the conventional coating apparatus of FIG. 2(*a*), FIG. 3 is a schematic sectional view showing an essential portion of a coating apparatus according to one embodiment of the present invention, FIG. 3*a* is a view similar to FIG. 3 showing a slightly modified form of the apparatus of FIG. 3;

FIG. 4 is a chart showing a comparison of distributions of lack of uniformity of the coating film between the conventional coating apparatus and the coating apparatus of the present invention, FIG. 5 is a view similar to FIG. 3, but particularly shows a modification thereof, FIG. 6(*a*) is a view similar to FIG. 3, but particularly shows a further modification thereof, FIG. 6(*b*) is a top plan view of a thrust bearing employed in the coating apparatus of FIG. 6(*a*), FIG. 7(*a*) is a view similar to FIG. 3, but particularly shows a still further modification thereof, and FIG. 7(*b*) is a top plan view of the bearing surface of a thrust bearing employed in the coating apparatus of FIG. 7(*a*).

Before the description of the present invention proceeds, it is to be noted that like parts are designated by like reference numerals throughout several views of the accompanying drawings.

Referring now to the drawings, there is shown in FIG. 3 a die coating apparatus D according to one embodiment of the present invention which comprises a floating die 10 and a thrust bearing 14 associated therewith. The floating die 10 has a tubular construction including a body portion 12 having a tapered inner surface portion 11*a* at its lower end and a narrowed portion 11*b* at its upper end which together form in the body portion 12 a funnel-shaped opening 11 gradually narrowing in the direction of advance of the wire 1, said opening acting as an excess material remaining opening, as described below, and a flange or flat plate portion 13 rigidly connected to or integrally having an upper end at the outlet or discharge end of the body portion 12 extending in a direction normal to the advancing direction of the wire 1. The thrust bearing 14 has, for example, a circular disc-like configuration and is provided on a lower bearing surface 14*b* with lubricating material 15 for reducing frictional force opposing movement of the bearing 14 in the radial direction. The bearing 14 has a central opening 14*a* extending coaxially therethrough and aligned with the opening 11 of the floating die 10 for allowing passage of the wire 1 which has passed through the solution 3 contained in the container 2 and also through the opening 11 so as to have excess coating material removed therefrom. The bearing surface 14*b* is directed toward the upper surface of the flat plate portion 13 of the die 10 and the bearing 14 contacts the flat plate portion 13 through the lubricating material 15. The thrust bearing 14 is adapted to receive the force due to the buoyancy of the above described floating die 10, which floats on the coating solution drawn up out of the body 3 of coating solution by the wire at a distance above the level of the body of the coating solution and simultaneously to laterally slidably support the die 10.

It should be noted here that the opening 11 in the floating die 10 described as formed by the funnel shaped inner surface portion 11*a* and the narrowed portion 11*b* in the above embodiment may be replaced by an opening which gradually narrows upwardly toward the discharge side of the floating die in a stepped manner as shown in FIG. 3*a*, in which the parts the same as those in FIG. 3 have the same reference numbers. Body portion 12*a* has the interior surface stepped inwardly and upwardly.

As is clear from the foregoing construction, since the buoyancy due to the hydrodynamic effect of the coating solution 3 exerted on the floating die 10 is opposed by the thrust bearing 14, with the floating die 10 being consequently limited positionally at a predetermined height, the mass of the die 10 can be reduced, while the lower end of the die 10 can be disposed closer to the surface of the coating solution 3 in the container 2 so as to reduce the mass at the raised portion 8 of the coating solution 3, whereby the response of the floating die 10 for restoring the coaxial relation between the die 10 and the bearing 14 is remarkably improved. More specifically, in the above described arrangement of the invention, since the floating die 10 can be moved in the direction to restore the coaxial relation between the die 10 and the thrust bearing 14 in correspondence with variations in the minor clearances between the narrow portion 11*b* of the die 10 and the wire 1, the coating film 6 can be formed on the surface of the wire 1 with a uniform thickness at all times, while workability is improved to an appreciable extent, because the floating die 10 need not be adjusted due to its mass so as to be maintained at the proper floating condition.

Referring to the chart of FIG. 4, there are shown distribution (a) of the degree of lack of uniformity of the coating film 6 applied to the wire 1 by means of the conventional coating apparatus, and distribution (b) of the degree of lack of uniformity of the coating film 6 applied to the wire 1 by the use of the coating apparatus according to the present invention. The distribution chart of FIG. 4 is based on the results obtained from one hundred samples, in each of which polyvinyl formal was applied six separate times onto a copper wire 0.6 mm in diameter and 10 m in length to form thereon a coating film 6 which was 20μ or more thick. In the distribution chart, the values of the degree of lack of uniformity of the coating film obtained by division of the maximum thickness of the coating film 6 by the minimum thickness thereof are along the abscissa, while the ratios of the number of the samples having values corresponding to the degree of lack of uniformity to one hundred samples are along the ordinate.

In the table below, the results in the chart of FIG. 4 are summarized, in which table, A represents the average value of the degree of lack of uniformity of the coating film, B the standard deviation of the degree of lack of uniformity C the addition of the standard deviation B to the average value A, and D the difference between the average value A and the standard deviation C.

TABLE

| | Conventional coating apparatus | Coating apparatus of present invention |
|---|---|---|
| A | 1.68 | 1.16 |
| B | 1.11 | 0.21 |
| C | 2.73 | 1.37 |
| D | 0.57 | 0.95 |

It is clear from the deviation chart of FIG. 4 and the TABLE given above that a coating film 6 of uniform thickness can be obtained on the wire 1 at all times by the employment of the coating apparatus according to the present invention, which gave the average value A of 1.16 and standard deviation B of 0.21 for the degree of lack of uniformity of the coating film 6 as compared with the average value A of 1.68 and standard deviation B of 1.11 obtained with the use of the conventional coating apparatus.

Referring now to FIG. 5, there is shown a modification of the coating apparatus D of FIG. 3. In the modified coating apparatus DA which is particularly intended to prevent the possibility of soiling of the coating film 6 on the wire 1 due to adhesion of the lubricating material 15 employed to reduce the frictional force in the radial direction between the floating die 10 and the thrust bearing 14, the flat plate or flange 13 described as provided at the upper end of the tubular body portion 12 in the apparatus of FIG. 3 is replaced by a similar flat plate 13' formed on the outer periphery of the body portion 12 at a position spaced from the upper end of the body portion 12 and adjacent to a junction between the tapered portion 11*a* and narrow portion 11*b* of the opening 11, with the narrow portion 11*b* extending into the opening 14*a* in the thrust bearing 14 in a coaxial relation to the latter so as to form a partition wall between the wire 1 and the lubricating material 15. By the above arrangement, an undesirable adhesion of the lubricating material 15 to the coating film 6 on the wire 1 and consequent soiling of the coating film 6 are advantageously prevented.

Since other parts and functions of the coating apparatus DA of FIG. 5 are similar to those in the apparatus D of FIG. 3, a detailed description thereof is omitted for brevity.

Referring to FIGS. 6(*a* ) to 7(*b*), there are shown further modifications of the coating apparatus D of FIG. 3. These modifications in which the lubricating material 15 described as employed in the apparatus D of FIG. 3 is replaced by air as lubricating means particularly aim at solving the problem that, if the lubricating property of the lubricating material 15 for reducing the frictional force in the radial direction between the floating die 10 and the thrust bearing 14 is inferior, the floating die 10 tends to be difficult to move with respect to the fixed thrust bearing 14 so as to efficiently follow-up the lateral movement of the advancing wire 1.

In the modified coating apparatus DB of FIGS. 6(*a*) and 6(*b*) in which a static pressure type pneumatic bearing is employed, a circular groove 16 is formed on the bearing surface 14'*b* of the thrust bearing 14' concentric with the opening 14'*a* and at a position approximately half way between the outer periphery and inner periphery of the bearing 14', and a plurality of air vents or openings, for example four openings 17, each communicating with a supply pipe 17*a* for compressed air are formed through the bearing 14' and opening into the groove 16 for supplying the compressed air into said groove 16. By the above arrangement, the compressed air thus fed into the groove 16 flows between the bearing surface 14'*b* of the thrust bearing 14' and the corresponding surface of the flat plate portion 13 of the floating die 10 in the direction shown by the arrows in FIG. 6(*a*), and thus, the bearing surface 14'*b* of the bearing 14' confronts the flat plate portion 13 of the floating die 10 with the stream of the compressed air therebetween, with only an extremely small frictional force acting therebetween, so that the follow-up performance of the floating die 10 with respect to the lateral movement of the wire 1 is further improved as compared with the case where the lubricating material 15 is employed as in the apparatus D of FIG. 3.

In the modified coating apparatus DC of FIGS. 7(*a*) and 7(*b*) in which a dynamic pressure type pneumatic bearing is employed, a blade member 18 having a spiral configuration or the like is formed, for example, on the bearing surface 14''*b* of the thrust bearing 14'' having the through opening 14''*a* and upon rotation of the bearing 14'' relative to the floating die 10 there is formed a layer of air therebetween, by which arrangement, the frictional force acting between the bearing surface 14''*b* and the corresponding surface of the flat plate portion 13 of the floating die 10 is reduced to an extremely small level, and thus, the follow-up performance of the floating die 10 with respect to the lateral deflection of the wire 1 is further improved similarly to the case of the coating apparatus DB of FIG. 6(*a*) and 6(*b*) in which a static pressure type pneumatic bearing is used, with consequent further improvement in the uniformity of the thickness of the coating film 6.

It is to be noted here that the blade member 18 described as formed on the bearing surface 14''*b* of the thrust bearing 14'' in the above embodiment of FIGS. 7(*a*) and 7(*b*) may be formed on the surface of the flat plate portion 13 of the floating die 10 opposed to the bearing surface 14''*b*.

Since other constructions and functions of the coating apparatuses DB and DC of FIGS. 6(*a*) to 7(*b*) are similar to those in the apparatus D of FIG. 3, a detailed description thereof is omitted for brevity.

As is clear from the foregoing description, according to the coating apparatus of the present invention, since the thrust bearing having lubricating means for reducing the friction in the radial direction is disposed at the discharge side of the opening through the floating die and in a direction normal to the advancing path of the material to be coated after having passed through the coating solution, the follow-up performance of the floating die with respect to the lateral movement of the material to be coated is greatly improved, and thus, not only can a coating film having uniform thickness be formed on the surface of the material to be coated, but the adjusting of the mass of the floating die for maintaining the die in the floating condition is made unnecessary, with consequent improvement in workability and providing a coating apparatus having a simple construction and high reliability which is extremely useful for the industry.

Although the present invention has been fully described by way of example with reference to the attached drawings, it is to be noted that various changes and modifications will be apparent to those skilled in the art. Therefore, unless otherwise such changes and modifications depart from the scope of the present invention, they should be construed as included therein.

What is claimed is:

1. A coating apparatus for applying a coating solution onto a material to be coated which comprises: coating solution holding means for holding a body of coating solution to be coated onto a material and which is at a normal level in said means; a floating die member positioned above said level of the coating solution in said holding means and having an excess material removing opening therethrough for allowing the material to be coated after having passed through the coating solution to pass therethrough, said opening gradually narrowing in the direction of advance of said material to be coated, said die member being above said level of said coating solution a distance for being floated on the coating solution drawn up out of the body of coating solution by the material being coated as it passes through the body of coating solution; a thrust bearing member above said die member and having an opening therein; and lubricating means for reducing friction in the radial direction thereof between said thrust bearing member and said floating die member and extending in a direction normal to the advancing direction of said material to be coated, said opening in said thrust bearing member being aligned with said opening in said floating die member.

2. A coating apparatus as claimed in claim 1, wherein said floating die member has a tubular body portion having said opening extending axially therethrough, and a flat plate portion disposed on the outer periphery of said tubular body portion so as to confront a surface of said thrust bearing member.

3. A coating apparatus as claimed in claim 2, wherein said opening in said floating die member is funnel shaped and gradually narrows in the direction of the advance of said material to be coated.

4. A coating apparatus as claimed in claim 2, wherein said opening in said floating die member is stepped and gradually narrows in the direction of the advance of said material to be coated.

5. A coating apparatus as claimed in claim 2, wherein said flat plate portion is disposed on said outer periphery of said tubular body portion at a position spaced from the discharge end of said tubular body portion, part of said tubular body portion being coaxially positioned in said opening in said thrust bearing member for allowing the material to be coated to pass therethrough.

6. A coating apparatus as claimed in claim 1, wherein said lubricating means between said thrust bearing member and said floating die member is air.

7. A coating apparatus as claimed in claim 1, wherein said floating die member has a flat plate portion and said thrust bearing member has a bearing surface opposed to said flat plate portion, said bearing surface having at least one air vent therein for supplying compressed air between said bearing surface and said flat plate portion for constituting said lubricating means.

8. A method for applying a coating solution onto a material to be coated by employing a coating apparatus which includes a floating die member having an opening therethrough, said opening gradually narrowing in the direction of advance of said material to be coated, and a thrust bearing member having an opening therein and lubricating means for reducing friction in the radial direction thereof between said floating die member and said thrust bearing and extending in a direction normal to the advancing direction of said material to be coated, said opening of said thrust bearing member being aligned with said opening in said floating die member, said coating solution applying method comprising the steps of passing the material to be coated upwardly through the coating solution and then through said opening in said floating die member for causing the die member to float on the coating solution drawn upwardly by the material to be coated and for removing excess coating solution and subsequently passing said material to be coated through said opening in said thrust bearing member for improving the follow-up performance of said floating die member with respect to lateral movement of said material to be coated as it is advancing through said floating die member and said thrust bearing member for formation of coating film of the coating solution having a uniform thickness on said material to be coated.

* * * * *